US006120021A

United States Patent [19]

Piotrowski et al.

[11] Patent Number: 6,120,021

[45] Date of Patent: Sep. 19, 2000

[54] LOCK-DOWN BAR RELEASE SYSTEM FOR A PINBALL MACHINE

[75] Inventors: Peter J. Piotrowski, Long Grove; John R. Krutsch, Lake Villa; George A. Gomez, Evanston; James A. Patla, Rolling Meadows; Charles R. Bleich, Cary, all of Ill.

[73] Assignee: Williams Electronics Games, Inc., Chicago, Ill.

[21] Appl. No.: 09/231,092

[22] Filed: Jan. 14, 1999

[51] Int. Cl.[7] ..... A63F 7/02

[52] U.S. Cl. ..... 273/118 R; 273/119 R; 273/121 R

[58] Field of Search ..... 273/118 R, 118 A, 273/119 R, 119 A, 121 R, 121 A; 312/109, 326

[56] References Cited

U.S. PATENT DOCUMENTS

| | | | |
|---|---|---|---|
| 2,468,452 | 4/1949 | Leverenz . | |
| 2,845,618 | 7/1958 | Huffman . | |
| 3,549,803 | 12/1970 | Becht et al. . | |
| 4,093,347 | 6/1978 | La Russa . | |
| 4,189,145 | 2/1980 | Stubben et al. . | |
| 4,305,095 | 12/1981 | Dallas . | |
| 4,306,768 | 12/1981 | Egging . | |
| 4,367,876 | 1/1983 | Kotoyori . | |
| 4,371,164 | 2/1983 | Halliburton . | |
| 4,375,286 | 3/1983 | Seitz et al. . | |
| 4,421,317 | 12/1983 | Hector et al. . | |
| 4,448,417 | 5/1984 | Clark et al. . | |
| 4,490,745 | 12/1984 | Erickson et al. . | |
| 4,736,214 | 4/1988 | Rogers . | |
| 4,805,906 | 2/1989 | Wiczer et al. | 273/119 A |

(List continued on next page.)

FOREIGN PATENT DOCUMENTS

| | | |
|---|---|---|
| 3023878 | 1/1982 | Germany . |
| 2 124 505 | 2/1984 | United Kingdom . |
| WO 8401908 | 5/1984 | WIPO . |

OTHER PUBLICATIONS

Description and Drawings of Lock–Down Bar Assembly by Nova Games Import–Export GmbH & Co., Hamburg, Germany, 1993.

Description and drawings of 10 Pin Deluxe game, Williams Electronics Games, Inc., Chicago, Illinois, date unknown.

Description and photograph of Namco redemption game, Namco, Ltd., Tokyo, Japan, date unknown.

Brochure for 10 Pin Deluxe Game, Midway Games Inc., Chicago, Illinois, date unknown.

*Primary Examiner*—Raleigh W. Chiu
*Attorney, Agent, or Firm*—Jenkens & Gilchrist

[57] ABSTRACT

A lock-down bar release system for a pinball machine serviceable in a location-service mode and an operator-service mode. The pinball machine includes a playfield disposed within a game cabinet and a lock-down bar for securing a playfield glass over the playfield and onto the game cabinet. A handle mechanism and associated latching structure is operable to release the lock-down bar. In the location-service mode, the movement of the handle and release of the lock-down bar is effected automatically by using a location-service key. In the operator-service mode, the operator uses an operator-service key to access the interior of the game cabinet through a coin door from wherein the operator may physically pull the handle to release the lock-down bar. The pinball machine includes a restraint mechanism for inhibiting removal of the playfield (and thereby preventing access to the coin box or cash box under the playfield) in the location-service mode. The restraint mechanism moves to a non-blocking position when the coin door is opened in the operator-service mode so as to permit removal of the playfield in the operator-service mode.

16 Claims, 10 Drawing Sheets

U.S. PATENT DOCUMENTS 4,853,764 8/1989 Sutter .
5,190,286 3/1993 Watanabe et al. .
5,221,083 6/1993 Dote .
5,284,235 2/1994 Tanaka ..... 194/344
5,316,303 5/1994 Trudeau et al. .
5,327,284 7/1994 Kuester .
5,351,966 10/1994 Tohyama et al. .
5,417,422 5/1995 Hansen .
5,418,579 5/1995 Jamieson et al. .
5,553,864 9/1996 Sitrick .
5,669,685 9/1997 Kotani et al. .
5,685,625 11/1997 Beaver .

LOCK-DOWN BAR RELEASE SYSTEM FOR A PINBALL MACHINE

FIELD OF THE INVENTION

The present invention relates generally to pinball machines having a lock-down bar for securing a playfield glass to a game cabinet and, more particularly, to a system for controllably releasing the lock-down bar to permit removal of the playfield glass and access to the playfield.

BACKGROUND OF THE INVENTION

Pinball machines are well-known amusement devices which include, generally, an inclined playfield housed within a game cabinet with a plurality of play features such as targets, bumpers and the like arranged on the playfield. The game cabinet typically includes a plate of glass on the top through which the player can view the playfield but which otherwise prevents player access to the playfield. A locking bracket mechanism known as a "lock-down bar" is commonly used to secure the glass in position over the playfield. To play the game, a player uses flippers to maintain a game ball (i.e., pinball) on the playfield and to direct the pinball toward the various play features. A processor-based control system controls operation of the game in response to player inputs in conjunction with various electrical and mechanical components housed within the game cabinet (e.g., lights, switches, solenoids, etc.). Many of these components are mounted on the underside of the playfield, although some may be mounted directly on the playfield.

Pinball machines usually include slot(s) or entry-way(s) for receiving items of value such as coins, tokens and the like in payment for playing the machine. Many pinball machines also include bill acceptor(s) for receiving currency. Such slot(s), entry-way(s) and/or bill acceptor(s) are usually provided on the front of the game cabinet, most typically on a "coin door" on the front of the game cabinet. Typically, any coins, tokens or cash deposited into the machine is received in a collection area (e.g., into a coin box or cash box) inside the cabinet of the pinball machine, underneath the playfield.

As can be appreciated, pinball machines are complex devices requiring periodic service and maintenance. Heretofore, such service was facilitated by an "operator service" key which opened the coin door and provided access to the game cabinet. Once inside the cabinet, the operator or serviceman could pull a handle to release the lock-down bar, then remove the playfield glass and/or playfield to perform the necessary service on the machine. Although this system is suitable for many service applications, it does not allow for relatively simple "location service" to the playfield (which might be needed, for example, to dislodge a pinball stuck on the playfield) where access to the underside of the playfield is not needed or desired. In these location service situations, it would be advantageous to prevent access to the underside of the playfield because such access provides an opportunity for unscrupulous individuals to take any money which may have been deposited into the collection area of the machine (e.g., into the coin box or cash box lying underneath the playfield).

Accordingly, there is a need for a system which would permit a location service mode for a pinball machine, in addition to the previously known operator service mode, wherein the location service mode involves releasing the lock-down bar and providing access to the playfield without opening the coin door and/or without permitting access to the collection area underneath the playfield. The present invention is directed to satisfying this need.

SUMMARY OF THE INVENTION

In accordance with one aspect of the present invention, there is provided a pinball machine serviceable in a plurality of service modes. The pinball machine comprises a game cabinet including a game playfield enclosed therein, a lock-down bar for releasably securing a cover plate to the game cabinet and a coin door for receiving items of value into the game cabinet. In one embodiment, a first key is used to attain "location" service access into the game cabinet and a second key is used to attain "operator" service access to the game cabinet. The first key (the "location-service" key) releases the lock-down bar without providing access to the coin door and without removal of the playfield and the second key (the "operator-service" key) opens the coin door.

In accordance with another aspect of the present invention, there is provided a lock-down bar release mechanism comprising a handle movable between a first position and a second position and latching means operably connected to the handle. In one embodiment, the latching means comprises a deformable slot catch mechanism which receives and engages a post extension of the lock-down bar (thereby securing the lock-down bar over the game cabinet) when in a latched position and expands so as to release the post extension when in an unlatched position. The latching means moves between the latched and unlatched positions in response to movement of the handle between the first and second positions. Movement of the handle may be effected by the location-service key or by opening the coin door with the operator-service key and then physically moving the handle.

In accordance with yet another aspect of the present invention, there is provided a key-responsive mechanism for moving the handle between the first and second positions in the location service mode. The key-responsive mechanism comprises a cam engageable with a control surface of the handle. The cam is movable between a first and second orientation in response to operation of the location-service key. In the first orientation, the cam is substantially disengaged from the control surface. When moved toward the second orientation, the cam engages the control surface in a driving contact so as to move the handle from the first position to the second position.

In accordance with still yet another aspect of the present invention, there is provided a playfield restraint mechanism for blocking removal of the playfield (and thereby preventing access to the coin box or cash box under the playfield) in the location-service mode. In one embodiment, the restraint mechanism comprises a blocking plate operably connected to the coin door so as to move to a non-blocking position when the coin door is opened in the operator-service mode. The restraint mechanism in one embodiment includes spring means for biasing the blocking plate into engagement with the coin door and forcing the coin door into a fully-open position when the coin door is opened in the operator-service mode.

BRIEF DESCRIPTION OF THE DRAWINGS

The foregoing and other advantages of the invention will become apparent upon reading the following detailed description and upon reference to the drawings in which.

Figure 1:
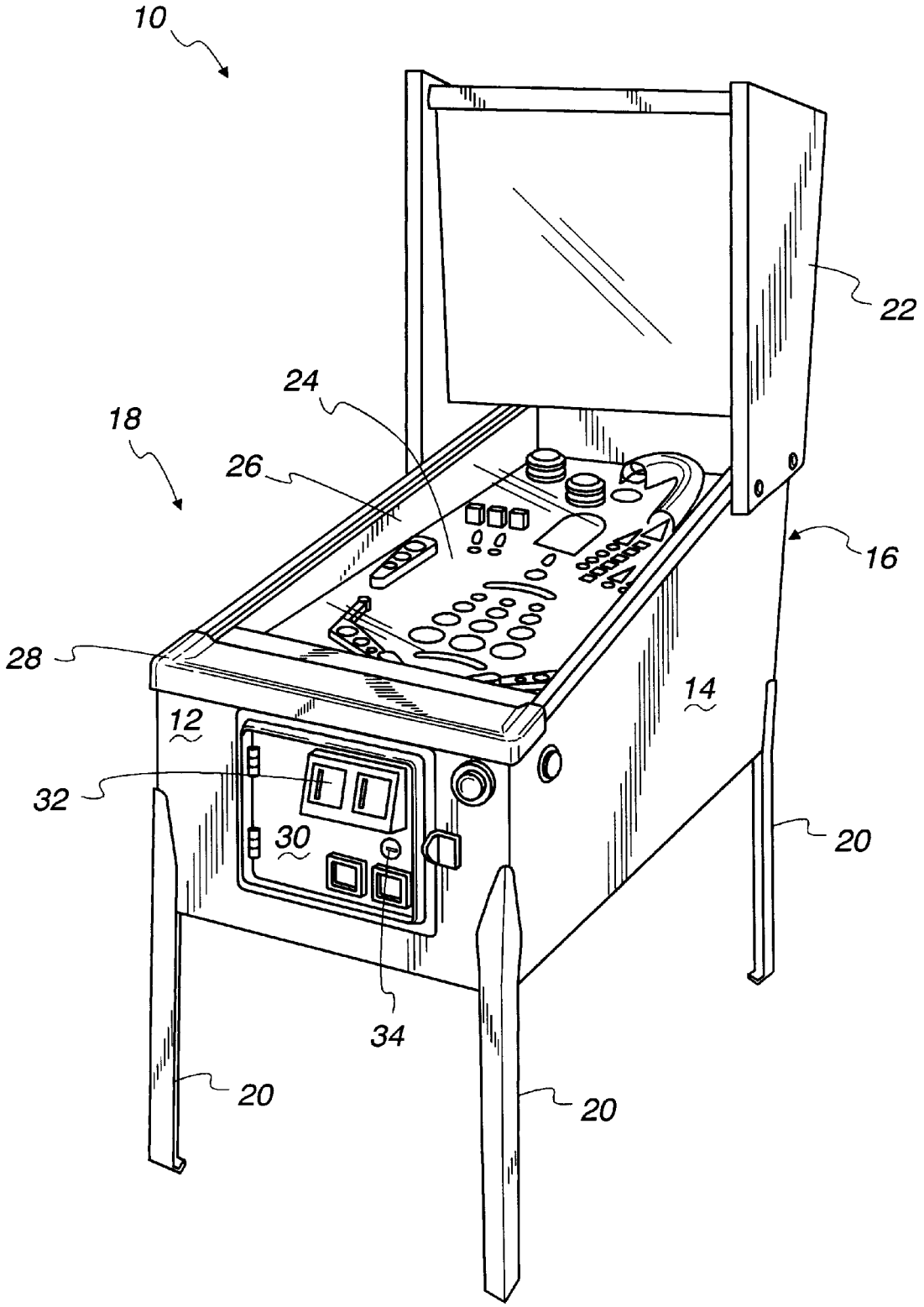
Fig. 1 Prior Art
FIG. 1 is a perspective view of a pinball machine game cabinet accessible only through an operator-service mode according to the prior art.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is shown a prior art pinball machine 10 including a front panel 12, side walls 14 and a rear panel 16 forming a generally box-like game cabinet 18 supported by legs 20. A back box 22 is provided for displaying game graphics and scoring information associated with the pinball machine 10. A game playfield 24 including various targets, bumpers and the like is angularly disposed within the game cabinet such that a pinball (not shown) will tend to roll downwardly toward the front of the cabinet unless maintained on the playfield 24 by flippers (not visible in FIG. 1).

The box-like cabinet 18 is covered with a plate of glass 26 (or clear plastic) through which the player can view the playfield 24 but which otherwise prevents player access to the playfield 24. A lock-down bar 28 secures the glass 26 in position over the playfield 24. A coin door 30 on the the front panel 12 includes slots 32 for accepting coins, tokens and the like in payment for playing the pinball game 10. The coin door 30 may also include a bill acceptor (not shown) for receiving currency in payment for playing the pinball game. Typically, the coins, tokens and/or currency deposited into the coin door 30 drop into a coin box or cash box (not shown) inside the cabinet 18 and under the playfield The coin door 30 is locked under normal operations to prevent player access to the interior of the game cabinet 18 and to the coins, tokens and the like which may have been received in the coin box or cash box therein. A keyway 34 and an associated operator key (not shown) permits the operator to open the coin door 30 as necessary when it is desired to service the machine and/or to collect money from the coin box or cash box. Upon opening the coin door 30, the operator may release the lock-down bar 28, remove the playfield glass 26 and the playfield 24 as necessary to service the pinball machine 10. A disadvantage associated with the prior art pinball machine 10, however, is that service to the machine 10 (including relatively simple service to the playfield) could not occur without opening the coin door 30 and providing access to the money inside.

The present invention provides in one embodiment a pinball machine 50 (as best observed in FIG. 9 or 10), which may be serviced in a "location-service" mode in addition to the above-described "operator-service" mode. Generally, the pinball machine 50 is operable in the location-service mode to release the lock-down bar 28 to access the playfield 24 but does not allow (in the location-service mode) the playfield 24 to be lifted from the cabinet 18. The pinball machine 50 otherwise includes generally the same elements of the prior art pinball machine 10 including a cabinet 18, playfield 24, glass 26, lock-down bar 28, coin door 30 and operator-service keyway 34 for opening the coin door in the operator-service mode, as heretofore described.

Figure 2:
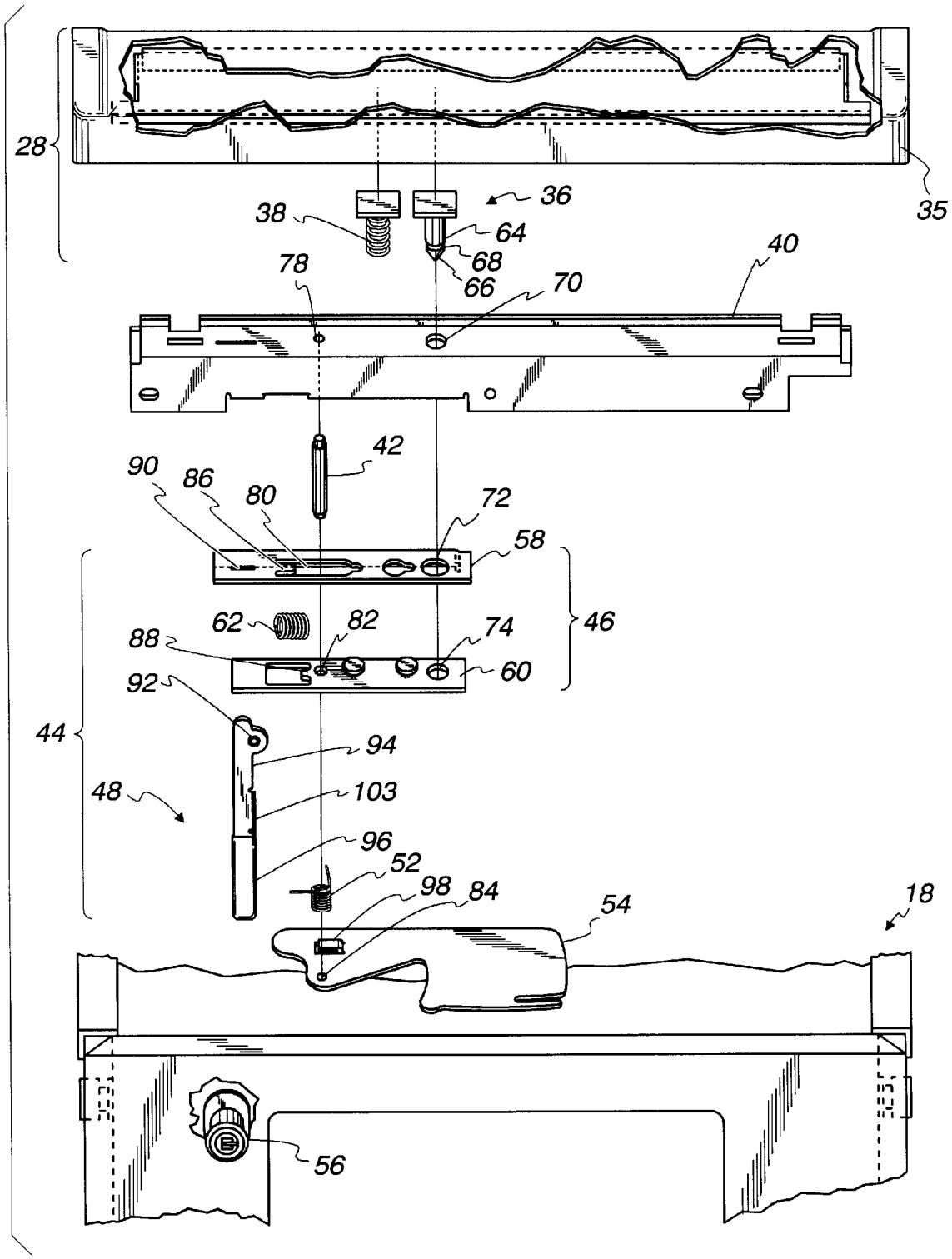
FIG. 2 is an exploded view showing a lock-down bar, latching mechanism and restraint mechanism for use in a pinball machine game cabinet accessible through a location-service mode according to one embodiment of the present invention.

FIG. 2 shows some of the elements of the pinball machine 50 in exploded view. The elements include, in order of descending appearance in FIG. 2, lock-down bar 28 (including comer plate 35, post extension 36 and spring 38), support bracket 40, pivot pin 42, lock-down bar release mechanism 44 (including latching mechanism 46 and handle 48), spring 52, blocking plate 54 and location-service keyway 56. The post extension 36 and spring 38 are fixedly secured to the underside of the comer plate 35 to define the lock-down bar 28. The post extension 36 of the lock-down bar 28 comprises a generally cylindrical projection 64 tapering inwardly at its distal end 66. The post extension 36 also includes near its distal end 66 a grooved section 68 having a relatively narrow diameter adapted for engagement with the latching mechanism 46. The latching mechanism 46 comprises a slideable bar 58, stationary bar 60 and spring 62. Each of these elements will be hereinafter be described in detail in relation to FIGS. 3–8.

Figure 3:
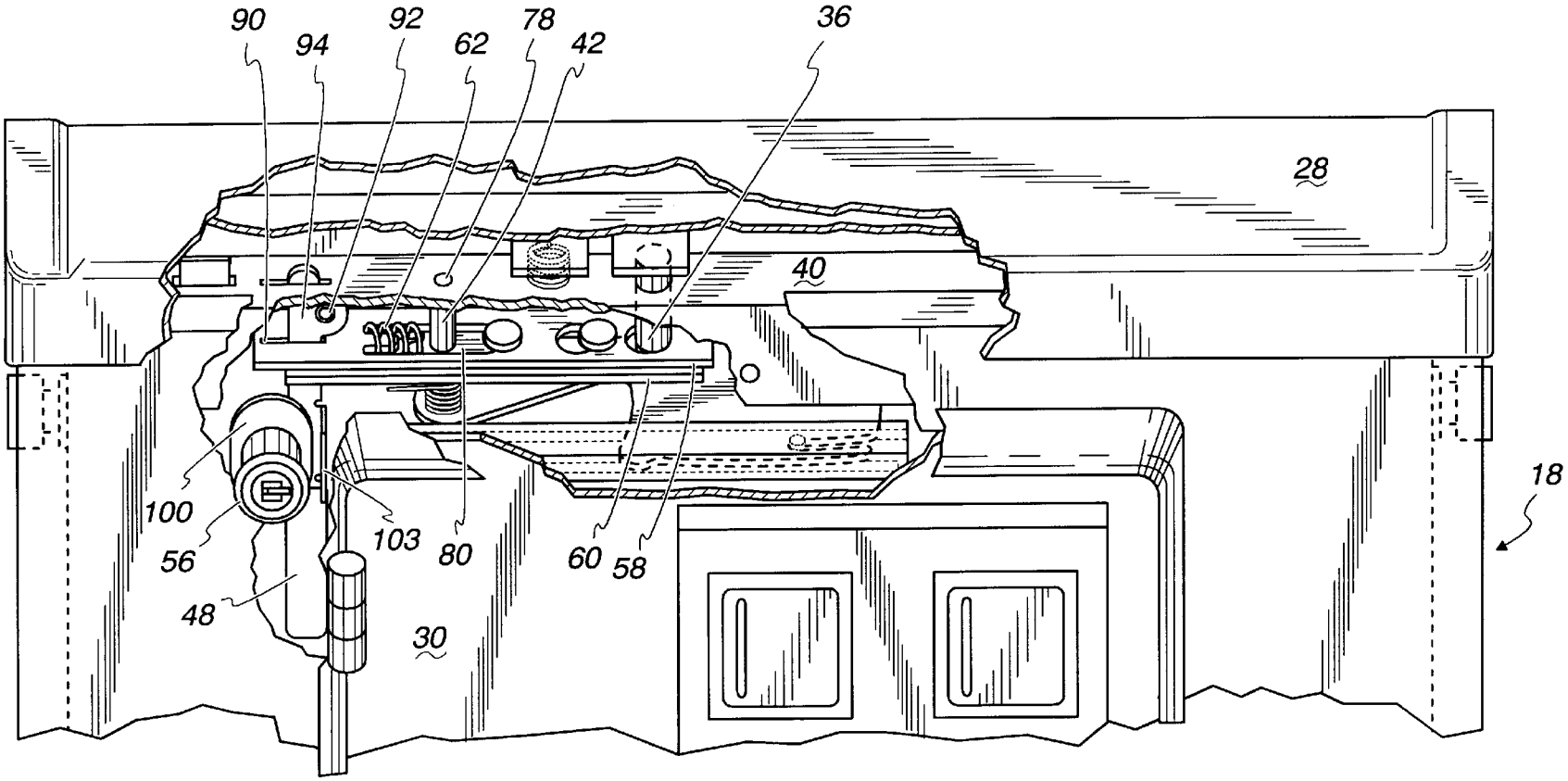
FIG. 3 is a perspective cut-away view of a pinball machine game cabinet including the lock-down bar, latching mechanism and restraint mechanism of FIG. 2 with the lock-down bar secured to the game cabinet.

FIG. 3 illustrates the appearance of the various elements of FIG. 2 inside the game cabinet 18, when the handle 48 is in a first, generally vertical position and when the lock-down bar 28 attached to the game cabinet 18. The lock-down bar 28 is attached to the game cabinet 18 upon inserting the post extension 36 through consecutively-aligned holes 70,72,74 in the support bracket 40, slideable bar 58 and stationary bar 60, respectively. Holes 70,72,74 are best observed in FIG. 2. The support bracket 40 is rigidly secured to the game cabinet. The pivot pin 42 extends from notch 78 (on support bracket 40) through slot 80 (on slideable bar 58), through hole 82 (on stationary bar 60) and then terminates at hole 84 (on blocking plate 54). Hole 82 and hole 84 are best observed in FIG. 2. The bars 58,60 are movable relative to each other in response to movement of the handle 48. The spring 62 engages with respective tabs 86,88 (FIG. 2) on the bars 58,60 so as to bias the movable bar 58 to the left as viewed from the front of cabinet 18.

Figure 4:
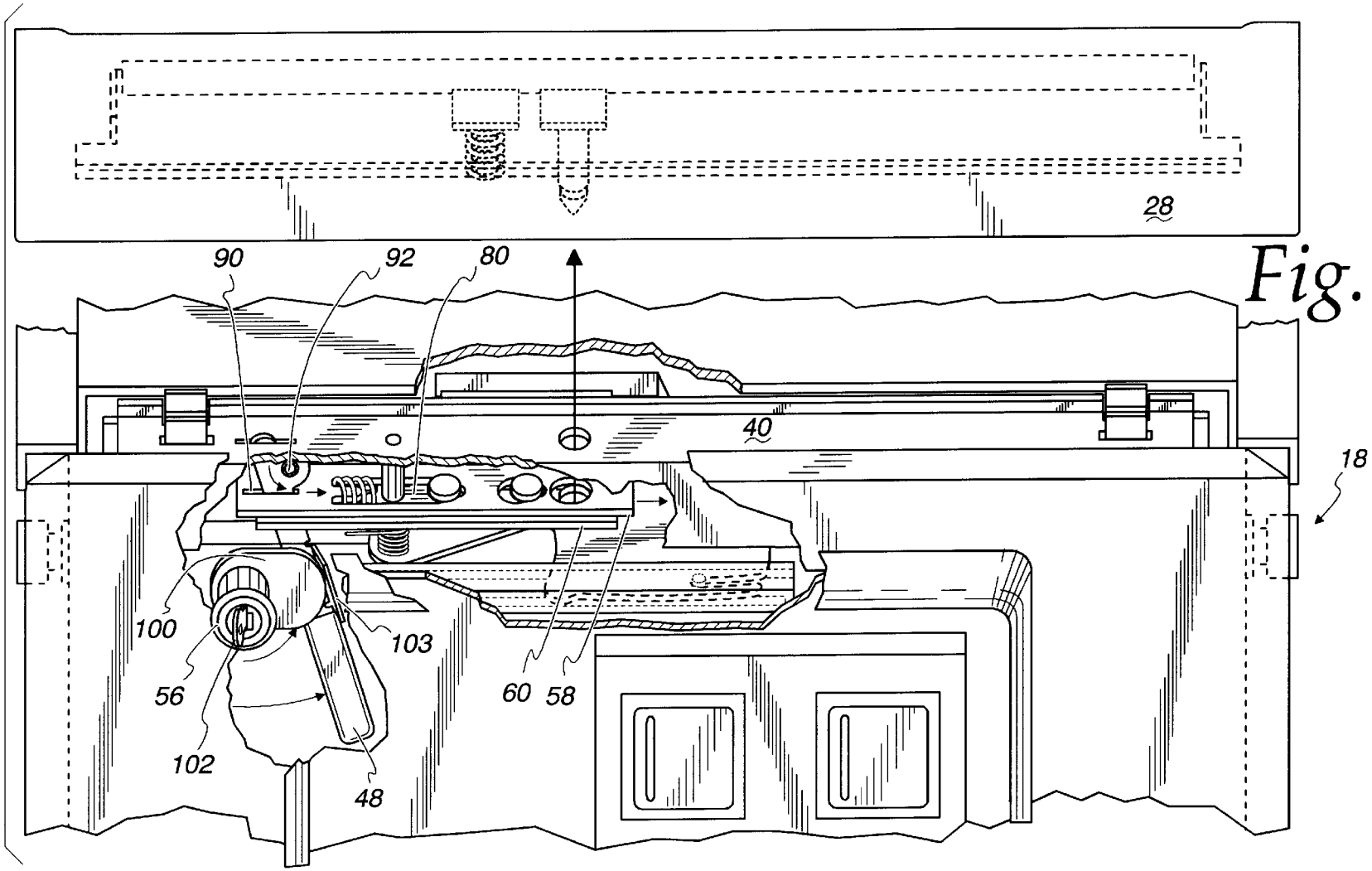
FIG. 4 is a perspective cut-away view of the pinball machine game cabinet of FIG. 3 illustrating the release of the lock-down bar in the location-service mode.

The handle 48 is mounted for pivotal movement about pivot point 92 and includes an upper section 94 extending through slot 90 of the slideable bar 58. Movement of the handle 48 may be effected in operator-service mode by an operator physically grasping and pulling a lower section 96 of the handle (FIG. 8) or in location-service mode by inserting and turning a location-service key 102 into keyway 56 (FIG. 4). The handle 48 includes a control surface 103 which is engageable with a cam 100 in the location-service mode. The cam 100 is movable between a first orientation (FIG. 3) and a second orientation (FIG. 4) in response to operation of the location-service key 102. In the first orientation (FIG. 3), the cam 100 has a generally vertical orientation and is substantially disengaged from the control surface 103. When moved toward the second orientation (FIG. 4), the cam 100 engages the control surface 103 in a driving contact so as to move the handle 48 counter-clockwise from the first position toward a second position.

Figure 11A:
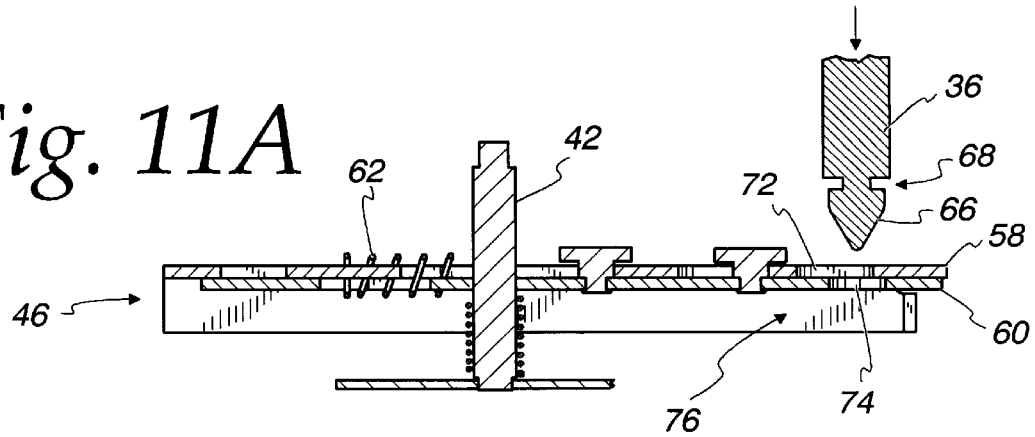
FIG. 11*a* is a side sectional view depicting the latching mechanism of FIG. 2 in an unlatched position and about to receive a post extension of the lock-down bar.
Figure 11B:
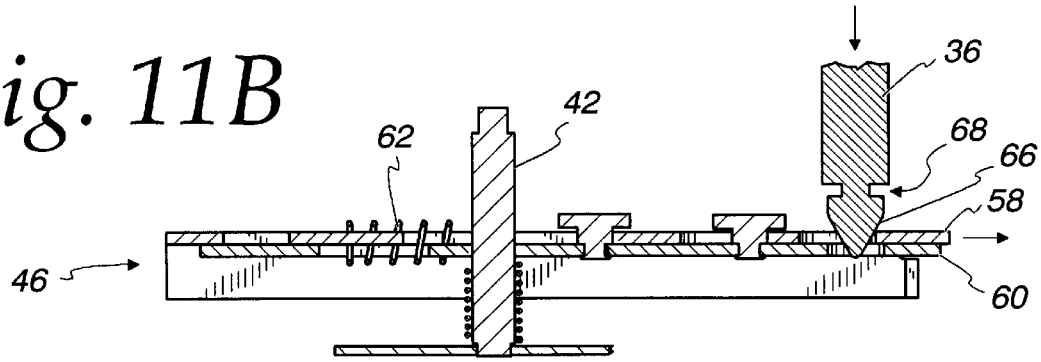
FIG. 11*b* is a side sectional view depicting the latching mechanism of FIG. 2 upon initial penetration of the post extension of the lock-down bar.
Figure 11C:
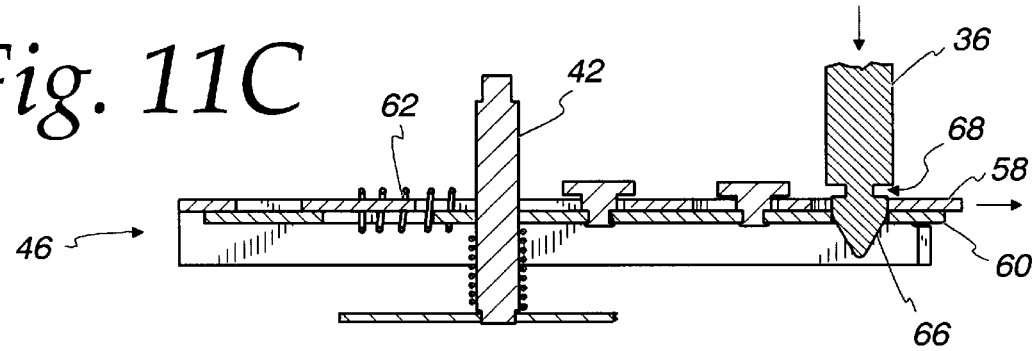
FIG. 11*c* is a side sectional view depicting the latching mechanism of FIG. 2 upon further penetration of the post extension of the lock-down bar.
Figure 11D:
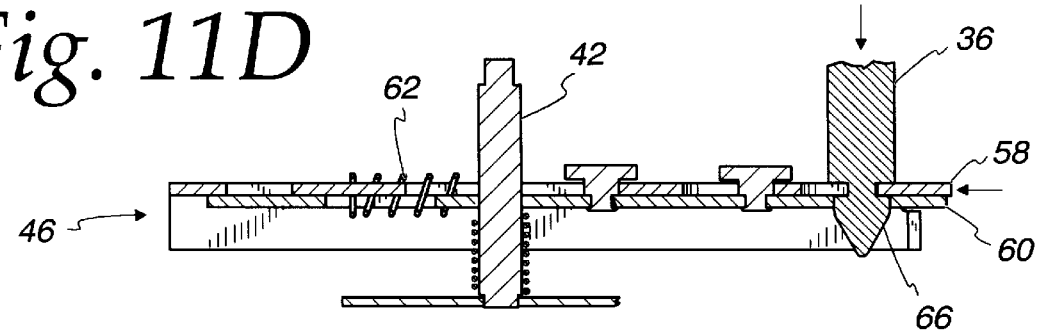
FIG. 11*d* is a side sectional view depicting the latching mechanism of FIG. 2 in a latched position upon still further penetration of the post extension of the lock-down bar.

As the handle 48 is moved in counter-clockwise fashion relative to the pivot point 92, the upper section 94 of the handle 48 engages the slideable bar 58 and causes it to move toward the right. In response to movement of the bars 58,60, their respective holes 72,74 move relative to each other to define in combination a "deformable slot" 76. The deformable slot 76 is best explained with reference to FIGS. 11*a* through 11*d*. With the post extension 36 disengaged from the latching mechanism 46, the slideable bar 58 is oriented as shown in FIG. 11*a*, with hole 72 overlying hole 74 in a generally skewed fashion, thereby defining in combination a deformable slot 76 with a relatively narrow boundary as viewed from the post extension 36. Upon initial penetration of the post extension 36 into the deformable slot 76, the bar 58 encounters the tapered end 66 of the post extension 36 and slides toward the right, as shown in FIGS. 11*b* and 11*c*. Then, upon encountering the grooved section 68 of the post extension 36, as shown in FIG. 11*d*, the bar 58 snaps back to the left. At this point, the deformable slot 76 again forms a relatively narrow boundary which receives and engages the grooved section 68 of the post extension 36 but, in view of its relatively narrow size, does not permit release of the post extension 36 until the bar 58 is again moved to the right in response to movement of the handle 48. More particularly, as the bar 58 is moved to the right, the boundary of the deformable slot 76 effectively increases so as to cause the post extension 36 to become disengaged from the deformable slot 76 and release the lock-down bar 28. The spring 38 (FIG. 2) serves to bias the lock-down bar 28 outwardly from the game cabinet 18 so that, upon release of the post extension 36, the lock-down bar 28 is ejected outwardly from the game cabinet 18.

Figure 5:
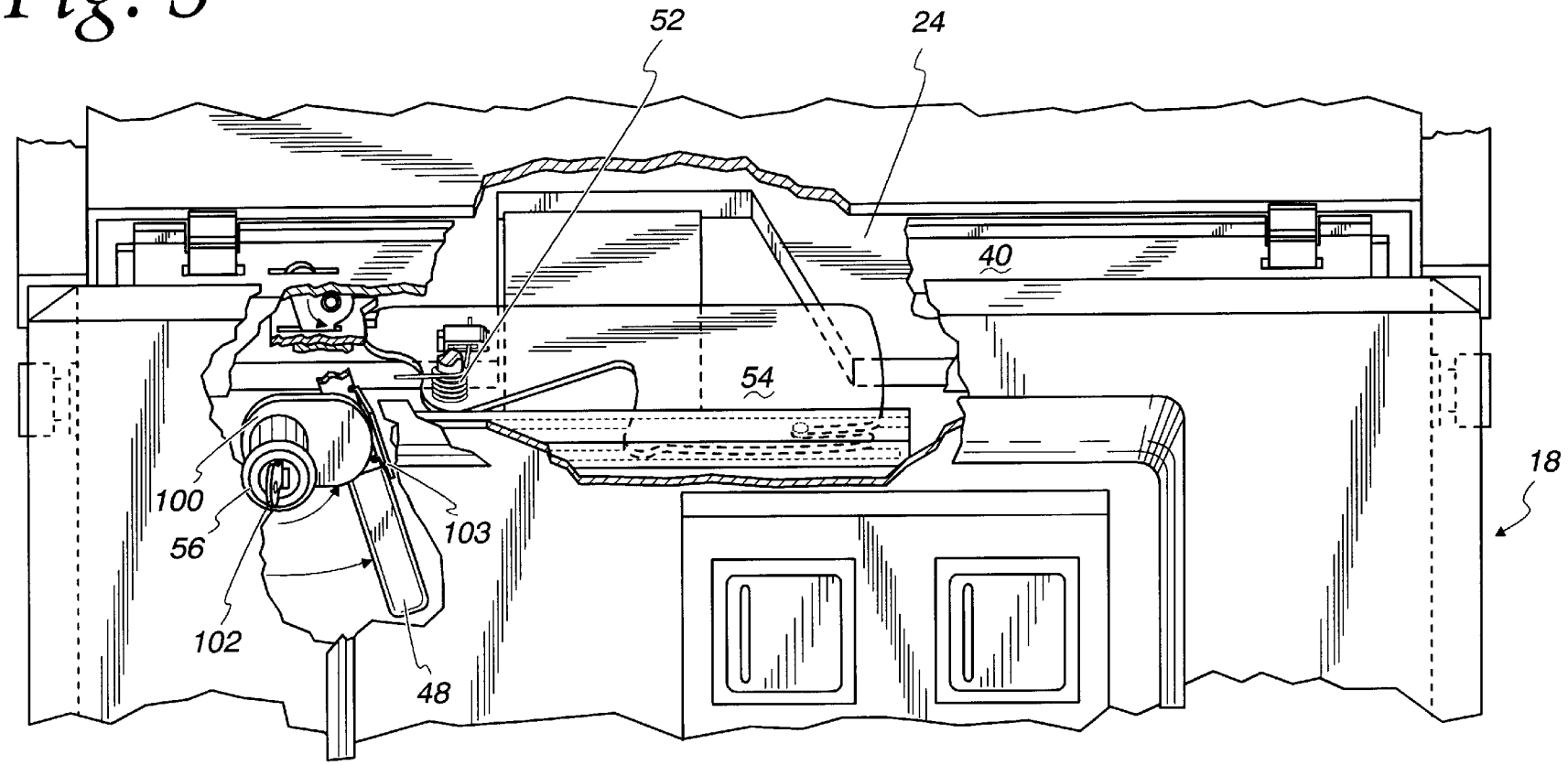
FIG. 5 is a perspective cut-away view of the pinball machine game cabinet of FIG. 3 illustrating the playfield restraint mechanism in a blocking position.
Figure 6:
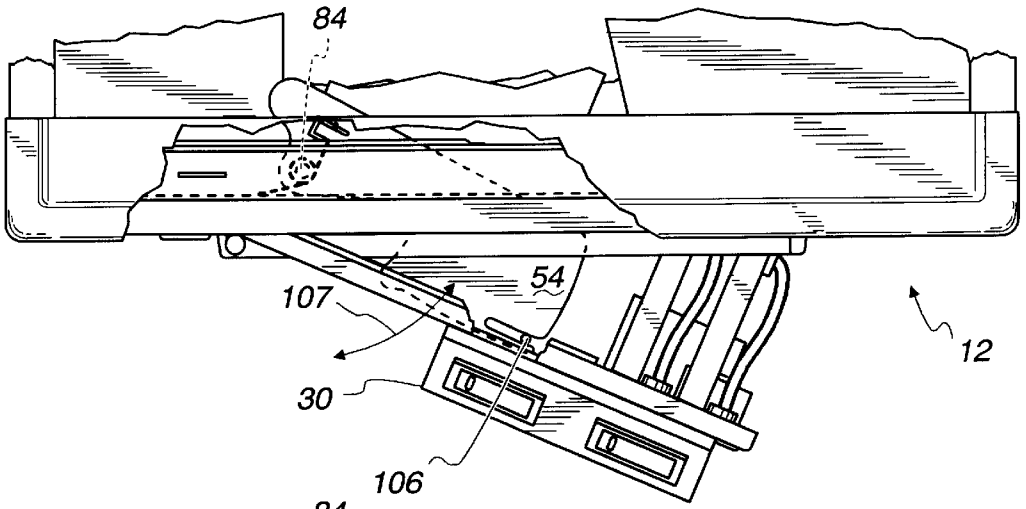
FIG. 6 is a top cut-away view showing the playfield restraint mechanism of FIG. 5 in relationship to a coin door as the restraint mechanism is moved between a blocking position and a non-blocking position.
Figure 7:
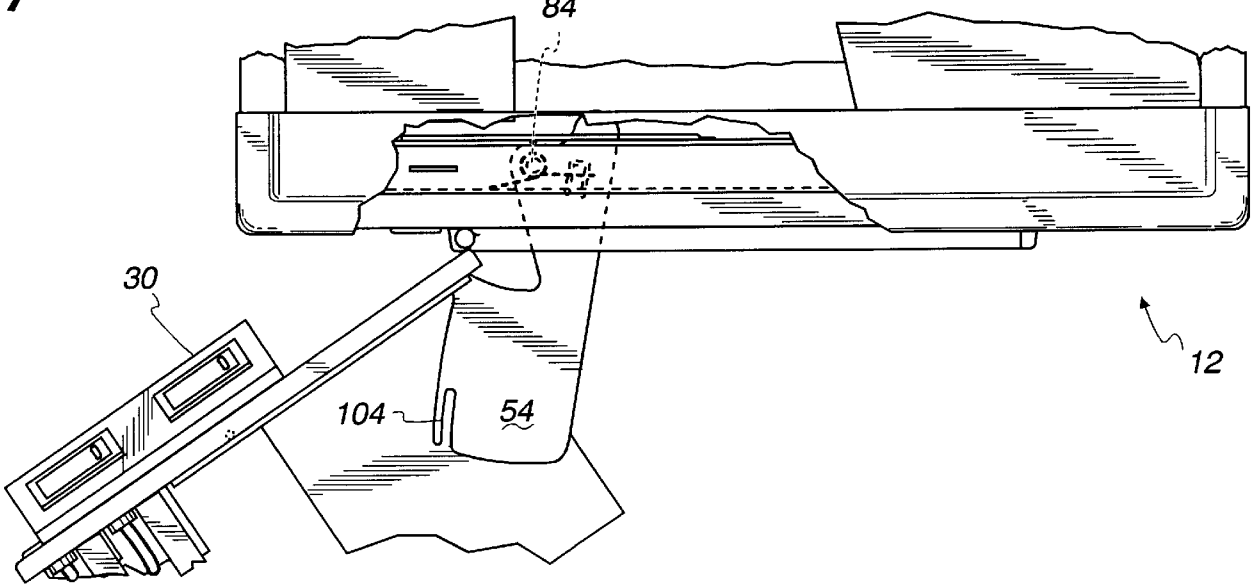
FIG. 7 is a top cut-away view showing the playfield restraint mechanism of FIG. 5 in relationship to a coin door when the restraint mechanism is in a non-blocking position.
Figure 8:
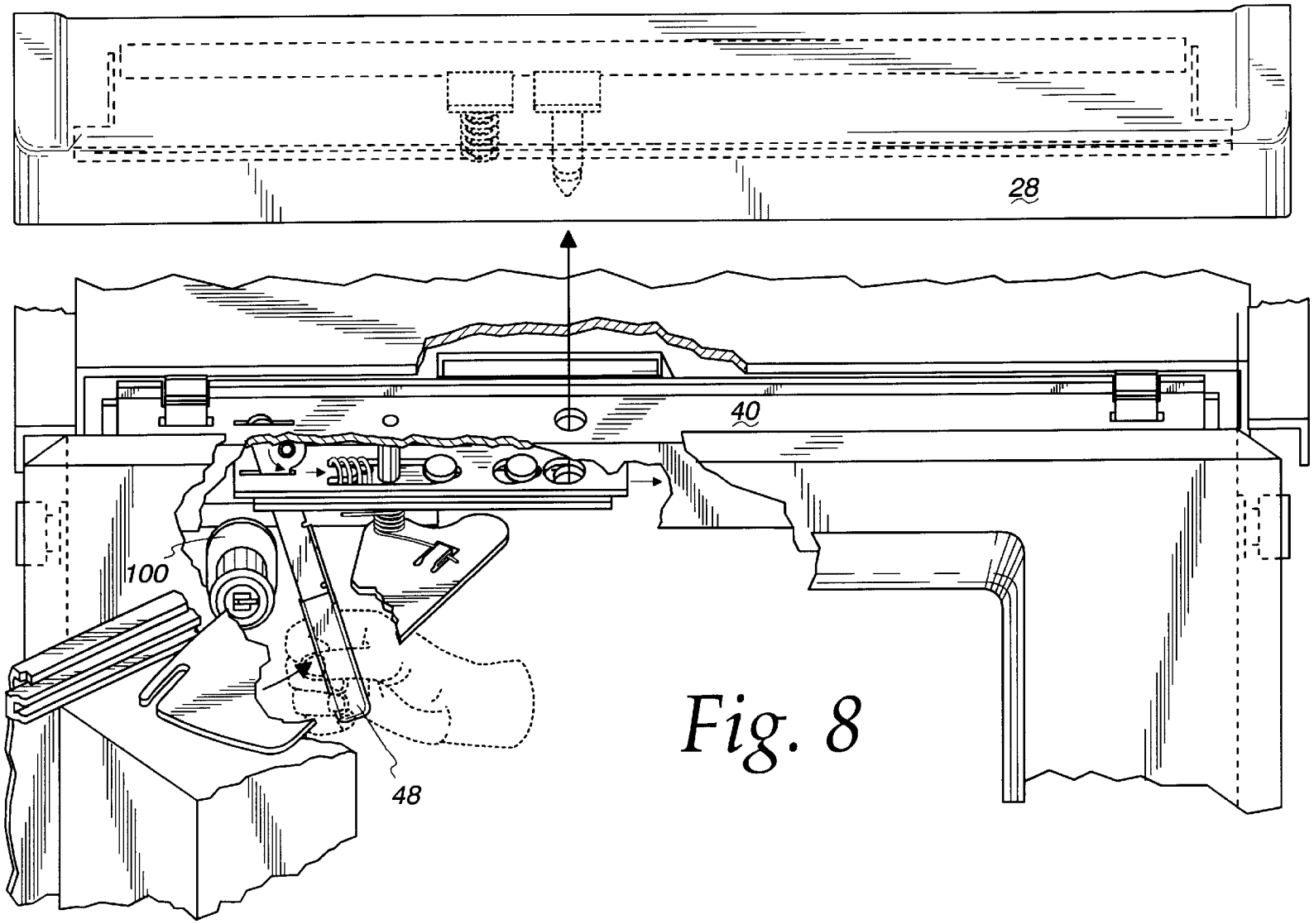
FIG. 8 is a perspective cut-away view of the pinball machine game cabinet of FIG. 3 illustrating the release of the lock-down bar in an operator-service mode.

As shown in FIGS. 5 through 7, the present invention includes a blocking plate 54 for blocking removal of the playfield 24 when the lock-down bar 28 is released in the location service mode. The blocking plate 54 is adapted for pivotal movement about a hole 84 (connected to the pivot pin 42) between blocking and non-blocking positions. When in the blocking position (FIG. 5), the blocking plate 54 overlies a front portion of the playfield 24 and provides a barrier to removal of the playfield 24. In effect, the playfield 24 is "locked down" by the blocking plate 54 in the location service mode because it can not be removed when the blocking plate 54 is in the blocking position.

The blocking plate 54 is connected to a spring 52 by means of a hook 98. The spring 52 biases the blocking plate 54 toward a non-blocking position. When in the non-blocking position (FIG. 7), the blocking plate does not overlie or block any portion of the playfield 24 and accordingly, the playfield 24 may be removed from the cabinet 18 (see FIG. 10) when the blocking plate is in the non-blocking position.

Figure 9:
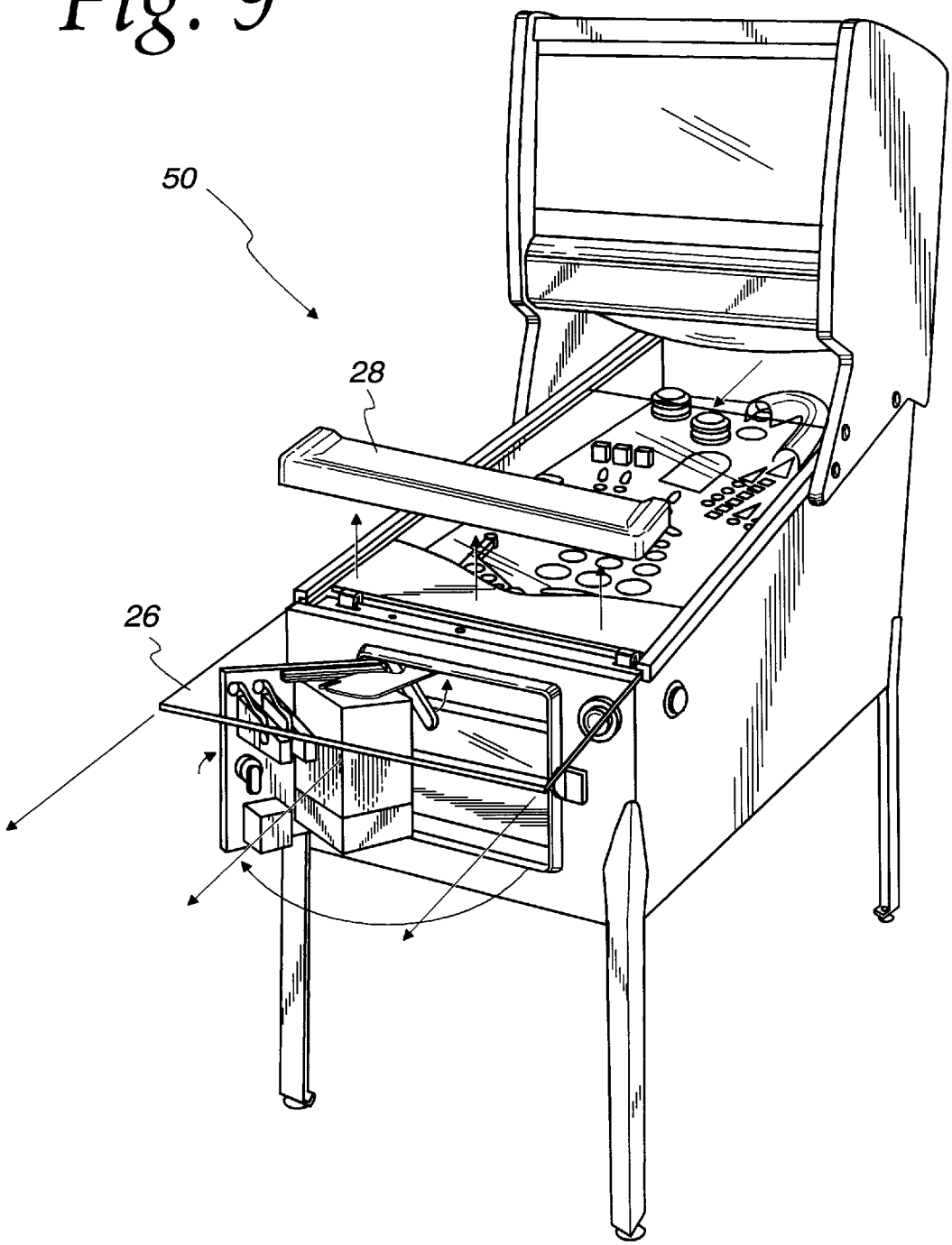
FIG. 9 is a partially-exploded perspective view of the pinball machine game cabinet of FIG. 3 illustrating removal of the playfield glass with the coin door fully open.
Figure 10:
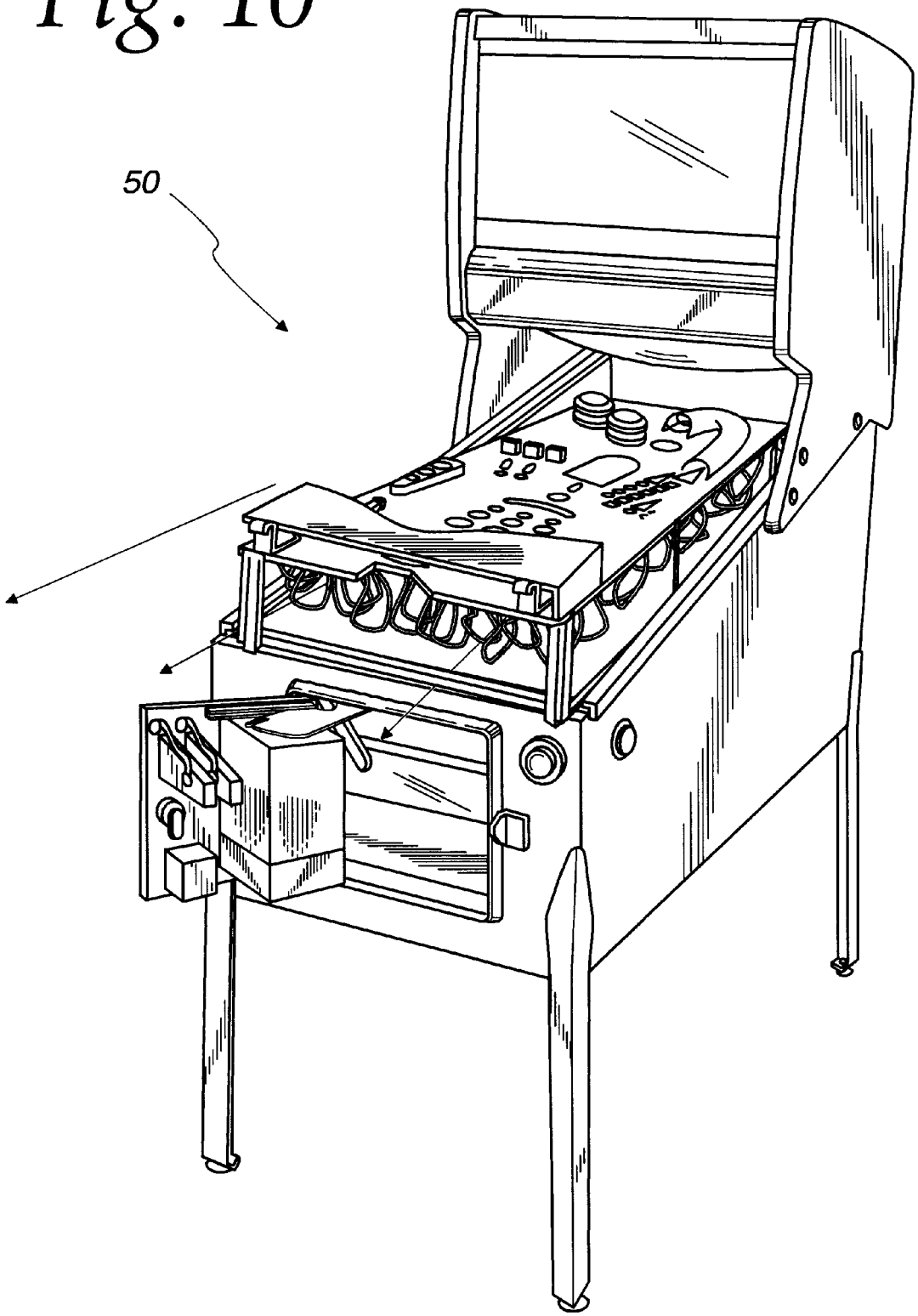
FIG. 10 is a perspective view of the pinball machine game cabinet of FIG. 9 illustrating removal of the playfield with the coin door fully open.

In one embodiment of the present invention, the blocking plate 54 is operably connected to the coin door 30. The coin door 30 is hingedly moveable in either direction (depicted by arrow 107) between closed and open positions. When the coin door 30 is closed (i.e., in the location-service mode), the coin door produces a force which overcomes the biasing force of spring 52 and pushes (or maintains) the blocking plate 54 into the cabinet in the blocking position. As the coin door 30 is opened (i.e., in the operator-service mode), the biasing force of the spring 52 causes the blocking plate 54 to swing outwardly away from the cabinet (FIG. 7). In one embodiment, the spring 52 produces a biasing force of sufficient strength so as to force the coin door into a fully open position (FIGS. 7 and 9) unless or until an operator closes (or holds in) the coin door with sufficient pressure to counteract the biasing force of spring 52. The advantageous effect of holding the coin door 30 fully open, as best observed in FIG. 9, is that it reduces the likelihood of the coin door 30 interfering with removal (and possible breakage) of the playfield glass 26.

In one embodiment, the blocking plate 54 includes a safety latch comprising a notch 104 engageable with pin 106. The notch is fully engaged with pin 106 when the blocking plate is in the blocking position (FIG. 5). As the coin door is first opened (FIG. 6), the notch 104 begins to slide out of engagement with pin 106 and then becomes disengaged with pin 106 when the coin door is fully open (FIG. 7). One of the advantageous features of the safety latch is that, while the notch 104 is engaged with pin 106, it maintains the blocking plate 54 adjacent to the coin door 30. Consequently, the safety latch prevents an individual from "holding back" the blocking plate 54 against the biasing force of the spring 52 (e.g., in the blocking position) with the coin door 30 open, from which position the blocking plate 54 if accidentally released could snap back toward the coin door and cause injury to the individual.

The term "game cabinet," as used herein, shall be understood to refer to the box-like structure enclosing the playfield and coin or cash box but not including the "back box."

The term "coin door," as used herein, shall be understood to refer to a door which may be opened to provide access to items of value which may have been deposited underneath the playfield, e.g., into a collection area under the playfield. Slots or entry-way(s) for receiving coins, tokens and the like, or bill acceptor(s) for receiving currency may or may not be provided on the coin door.

The term "collection area," as used herein, shall be understood to refer to the interior of the game cabinet under the game playfield, which may or may not include a coin box or cash box, which receives coins, tokens or other items of value after they have been deposited into the game cabinet.

While the present invention has been described with reference to one or more particular embodiments, those skilled in the art will recognize that many changes may be made thereto without departing from the spirit and scope of the present invention Each of these embodiments and obvious variations thereof is contemplated as falling within the spirit and scope of the claimed invention, which is set forth in the following claims.

What is claimed is:

1. A pinball machine serviceable in a plurality of service modes, the pinball machine comprising:

a game cabinet including a game playfield enclosed therein;

a collection area under the game playfield for receiving items of value deposited into the game cabinet;

first key-responsive means for attaining a first mode of service access into the game cabinet, the first mode of service access not providing access to the collection area; and second key-responsive means for attaining a second mode of service access into the game cabinet, the second mode of service access providing access to the collection area.

2. The pinball machine of claim 1 further comprising a lock-down bar for releasably securing a cover plate to the game cabinet, the first key-responsive means being operable in cooperation with a first key to release the lock-down bar.

3. The pinball machine of claim 1 further comprising a coin door on the front of the game cabinet, the second key-responsive means being operable in cooperation with a second key to unlock the coin door and provide access to the collection area.

4. A pinball machine comprising:

a game cabinet including a game playfield enclosed therein;

a collection area under the game playfield for receiving the items of value accepted into the game cabinet;

a lock-down bar for releasably securing a cover plate to the game cabinet;

a coin door movable between respective locked and unlocked modes, the coin door in said locked mode restricting access to the collection area, the coin door in said unlocked mode providing access to the collection area;

first key-responsive means operable in cooperation with a first key to release the lock-down bar when the coin door is in the locked mode; and second key-responsive means operable in cooperation with a second key to unlock the coin door and providing access for a human operator to release the lock-down bar without operation of said first key.

5. The pinball machine of claim 4 further comprising:

a handle movable between a first position and a second position; and latching means operably connected to the handle, the latching means moving from a latched position to an unlatched position in response to movement of the handle from the first position to the second position, the latching means when in the latched position securing the lock-down bar over the game cabinet, the latching means when in the unlatched position releasing the lock-down bar, wherein the first key-responsive means is operable in cooperation with the first key to move the handle from the first position to the second position, and wherein the second key-responsive means is operable in cooperation with the second key to unlock the coin door and providing access for a human operator to move the handle from the first position to the second position.

6. The pinball machine of claim 5 wherein the first key-responsive means comprises a cam engageable with a control surface of the handle, the cam being movable between a first and second orientation in response to operation of the first key, the cam in said first orientation being substantially disengaged from the control surface, the cam when moved toward the second orientation engaging the control surface in a driving contact so as to move the handle from the first position to the second position.

7. The pinball machine of claim 5 wherein the latching means comprises a catch mechanism defining a deformable slot, the slot being sized to receive and engage a post extension of the lock-down bar when in the latched position, the slot expanding so as to release the post extension when the latching mechanism is moved to the unlatched position.

8. The pinball machine of claim 4 further comprising a playfield restraint mechanism movable between a blocking position and a non-blocking position, the restraint mechanism when in the blocking position inhibiting removal of the playfield from the game cabinet, the restraint mechanism when in the non-blocking position permitting removal of the playfield from the game cabinet.

9. The pinball machine of claim 8 wherein the playfield restraint mechanism is operably connected to opening and closing of the coin door, the restraint mechanism moving from the blocking position to the non-blocking position in response to opening of the coin door, the restraint mechanism moving from the non-blocking position to the blocking position in response to thereafter closing the coin door.

10. The pinball machine of claim 8 wherein the playfield restraint mechanism comprises a blocking plate hingedly movable between said blocking and non-blocking positions and engageable with the coin door, the blocking plate when engaged with the coin door being adapted for movement between said blocking and non-blocking positions in cooperation with closing and opening of the coin door, wherein upon closing the coin door the blocking plate is in said blocking position overlying a front portion of the playfield and upon opening the coin door the blocking plate when engaged with the coin door is moved away from the playfield.

11. The pinball machine of claim 10 wherein the playfield restraint mechanism further comprises spring means for biasing the blocking plate into engagement with the coin door.

12. The pinball machine of claim 11 wherein the spring means forces the coin door into a fully-open position upon opening the coin door.

13. The pinball machine of claim 11 wherein the playfield restraint mechanism further comprises a safety latch for forcing the restraint mechanism into engagement with the coin door.

14. In a pinball machine having a playfield enclosed within a game cabinet by a lock-down bar, an apparatus for releasing the lock-down bar comprising:

a handle movable between a first position and a second position;

latching means operably connected to the handle, the latching means moving between a latched position and an unlatched position in response to movement of the handle between the first position and second position, the latching means securing the lock-down bar over the game cabinet when in the latched position, the latching means releasing the lock-down bar when in the unlatched position; and location-service means for moving the handle from the first position to the second position.

15. The apparatus of claim 14 wherein the location-service means comprises:

a cam engageable with a control surface of the handle;

key means for moving the cam between a first and second orientation, the cam in said first orientation being substantially disengaged from the control surface, the cam when moved toward the second orientation engaging the control surface in a driving contact so as to move the handle from the first position to the second position.

16. The apparatus of claim 14 wherein the latching means comprises a catch mechanism defining a deformable slot, the slot being sized to receive and engage a post extension of the lock-down bar when in the latched position, the slot being sized to release the post extension when in the unlatched position.

* * * * *